US005189998A

United States Patent [19]

Hara

[11] Patent Number: 5,189,998

[45] Date of Patent: Mar. 2, 1993

[54] VALVE MECHANISM OF INTERNAL COMBUSTION ENGINE

[75] Inventor: Seinosuke Hara, Kanagawa Prefecture, Japan

[73] Assignee: Atsugi Unisia Corporation, Atsugi, Japan

[21] Appl. No.: 914,576

[22] Filed: Jul. 20, 1992

[30] Foreign Application Priority Data

Jul. 23, 1991 [JP] Japan ..... 3-182179

[51] Int. Cl.[5] ..... F01L 1/34; F01L 1/18

[52] U.S. Cl. ..... 123/90.16; 123/90.39

[58] Field of Search ..... 123/90.16, 90.15, 90.39, 123/90.4

[56] References Cited

U.S. PATENT DOCUMENTS

| | | | |
|---|---|---|---|
| 4,469,056 | 9/1984 | Tourtelot, Jr. et al. | 123/90.16 |
| 4,526,142 | 7/1985 | Hara et al. | 123/90.16 |
| 4,567,861 | 2/1986 | Hara et al. | 123/90.16 |
| 4,572,118 | 2/1986 | Baguéna | 123/90.16 |
| 4,638,773 | 1/1987 | Bonvallet | 123/90.16 |
| 4,714,057 | 12/1987 | Wichart | 123/90.15 |
| 4,724,822 | 2/1988 | Bonvallet | 123/90.16 |

FOREIGN PATENT DOCUMENTS

| | | | |
|---|---|---|---|
| 3831642 | 3/1990 | Fed. Rep. of Germany | 123/90.15 |
| 44713 | 3/1982 | Japan | 123/90.15 |
| 228717 | 11/1985 | Japan | 123/90.16 |

*Primary Examiner*—E. Rollins Cross
*Assistant Examiner*—Weilun Lo
*Attorney, Agent, or Firm*—Foley & Lardner

[57] ABSTRACT

A valve mechanism for internal combustion engines of a type having a plurality of intake or exhaust valves for each cylinder is shown. A unique arrangement is applied to the valve mechanism for permitting the cam shaft to be positioned above the intake (or exhaust) valves. With the arrangement, the freedom in layout of an associated ignition spark plug in the engine is increased.

11 Claims, 6 Drawing Sheets

VALVE MECHANISM OF INTERNAL COMBUSTION ENGINE

BACKGROUND OF THE INVENTION

1. Field of the Invention

The present invention relates in general to valve mechanisms for internal combustion engines, and more particularly to valve mechanisms for automotive internal combustion engines of a type which has a plurality of intake or exhaust valves for each cylinder. More specifically, the present invention is concerned with valve mechanisms of a type which can control the valve timing and the valve lift in accordance with the engine condition.

2. Description of the Prior Art

As is known, for improving fuel consumption and operability at lower speed and lower load condition of the engine and obtaining a sufficient output at higher speed and higher load condition of the same, various valve mechanisms of the above-mentioned type have been proposed and put into practical use. One of such valve mechanisms is shown in Japanese Patent First Provisional Publication 60-26109.

In order to clarify the task of the present invention, the valve mechanism of the publication will be described with reference to FIG. 10 of the accompanying drawings. The valve mechanism shown is incorporated with an intake valve 3 of the engine.

In the drawing, denoted by numeral 1 is a cylinder head of an internal combustion engine. The cylinder head 1 has at its upper deck a cam shaft 2 on which a valve driving cam 2*a* is provided. Positioned near the cam shaft 2 is a rocker arm 4 whose one end is in contact with a cam face of the valve driving cam 2*a*. The other end of the rocker arm 4 is in contact with an upper end of a stem of the intake valve 3. The rocker arm 14 has a convexly curved back surface 5 to which a lever 6 contacts, so that the pivotal movement of the rocker arm 5 caused by the cam 2*a* is carried out having the curved back surface 5 controlled by the lever 6. That is, the lift of the cam 2*a* is transmitted to the intake valve 3 while being controlled by the lever 6. The lever 6 has one end rotatably supported by a supporting shaft 7 and has a sloped upper surface 6*a* against which a control cam 8 abuts. Denoted by numeral 9 is a valve spring by which the intake valve 3 is biased upward, that is, in a direction to close the intake port.

During engine operation, due to a known driving mechanism, such as hydraulic actuator or the like, the rotation of the control cam 8 is forced to change its phase in accordance with the engine condition, so that the valve timing and the valve lift of the intake valve 3 are continuously controlled. That is, when the lever 6 is depressed by a larger degree by the control cam 8, the contact of the rocker arm 4 to a base circle part of the cam 2*a* induces a close positioning of a free end of the lever 6 to the rocker arm 4, and thus, the valve open timing of the intake valve 3 is advanced and the valve lift of the same is increased. While, when the lever 6 is depressed by a smaller degree by the control cam 8, the contact of the rocker arm 4 to the base circle part of the cam 2*a* induces a remote positioning of the free end of the lever 6 to the rocker arm 4, and thus, the valve open timing of the intake valve 3 is delayed and the valve lift of the same is reduced.

However, due to its inherent construction, the above-mentioned conventional valve mechanism has to employ inevitably an arrangement wherein the cam shaft 2 and the valve driving cam 2*a* are placed at a middle zone of the upper deck of the cylinder head 1. Accordingly, in internal combustion engines having a plurality of intake or exhaust valves for each cylinder and thus having a plurality of valve driving cams for each cylinder, the freedom in layout of an associated ignition spark plug (not shown) relative to the valve driving cam 2*a* and the common cam shaft 2 on the upper deck of the cylinder head 1 is considerably limited and thus locating the ignition spark plug at a desired position in the associated combustion chamber is sometimes impossible or at least very difficult.

SUMMARY OF THE INVENTION

It is therefore an object of the present invention to provide a valve mechanism of the above-mentioned type for an internal combustion engine, which has a large freedom in layout of the ignition spark plug relative to the valve driving cam and the common cam shaft on the upper deck of the cylinder head 1.

According to the present invention, there is provided a valve mechanism of the above-mentioned type, in which the cam shaft of the valve driving cams is positioned above the intake (or exhaust) valves for increasing the freedom in layout of an associated ignition spark plug.

According to the present invention, there is provided a valve mechanism for an internal combustion engine having a plurality of intake or exhaust valves for each cylinder. The valve mechanism comprises a cam shaft rotated in synchronization with operation of the engine; a valve driving cam integrally mounted on the cam shaft to rotate therewith; a swing structure positioned below the valve driving cam, the swing structure being pivotally supported on a fixed portion of the engine and having leading ends which are respectively put on stems of the valves; a supporting shaft extending in parallel with the cam shaft; a cam follower having one end pivotally connected to the supporting shaft and the other end slidably engaged with the valve driving cam; a link structure pivotally connected to the supporting shaft and extending in a direction away from the cam follower, the link structure having a pivot shaft connected to the extending end thereof; a lever member having one end pivotally connected to the pivot shaft and the other end movably interposed between the swing structure and the cam follower; and a control means for pivoting the link structure about the supporting shaft in accordance with an operation condition of the engine.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

Referring to FIGS. 1 to 4, there is shown a valve mechanism according to the present invention, which is applied to an internal combustion engine having two intake valves for each cylinder.

Figure 1:
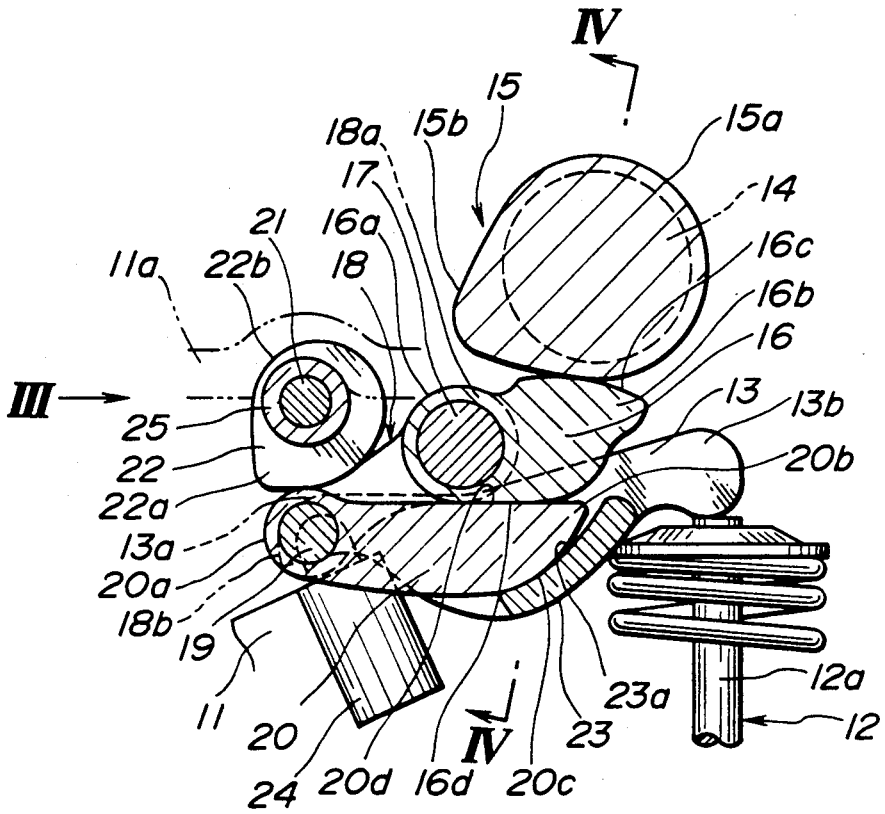
FIG. 1 is a sectional view of a valve mechanism of the present invention, which is taken along the line I—I of FIG. 2.

In FIG. 1, denoted by numeral 11 is a cylinder head to which paired intake valves 12 and 12 (see FIG. 2) are operatively connected through valve guides (not shown). As is seen from FIG. 2, two swing arms 13 and 13 are incorporated with the two intake valves 12 and 12 respectively. Positioned above the swing arms 13 and 13 is a cam shaft 14 which is rotatably supported by bearings (not shown) provided on the cylinder head 11. The cam shaft 14 has a valve driving cam 15 integrally formed thereon (see FIG. 4). It is to be noted that the valve driving cam 15 is employed for each pair of intake valves 12 and 12. The cam 15 comprises a base circle surface 15*a* and a raised surface 15*b*.

Positioned between the swing arms 13 and 13 and the driving cam 15 is a cam follower 16 which is tightly disposed on a supporting shaft 17. The supporting shaft 17 extends in parallel with the cam shaft 14 and has both ends rotatably supported by bearings (not shown) provided on the cylinder head 11. As is seen from FIG. 2, two link members 18 and 18 are pivotally connected to the supporting shaft 17. A lever member 20 is connected through a movable shaft 19 to the link members 18 and 18.

Figure 3:
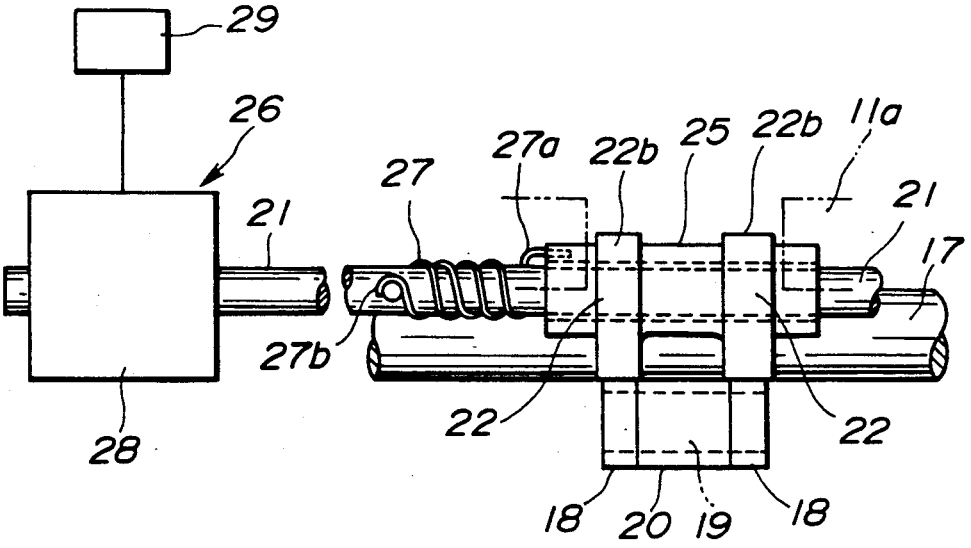
FIG. 3 is a view taken from the direction of the arrow "III" of FIG. 1.

As is seen from FIG. 3, a control shaft 21 is supported by a bracket 11*a* of the cylinder head 11. Two control cams 22 are secured to the control shaft 21 and in contact with the link members 18 and 18 respectively.

Figure 2:
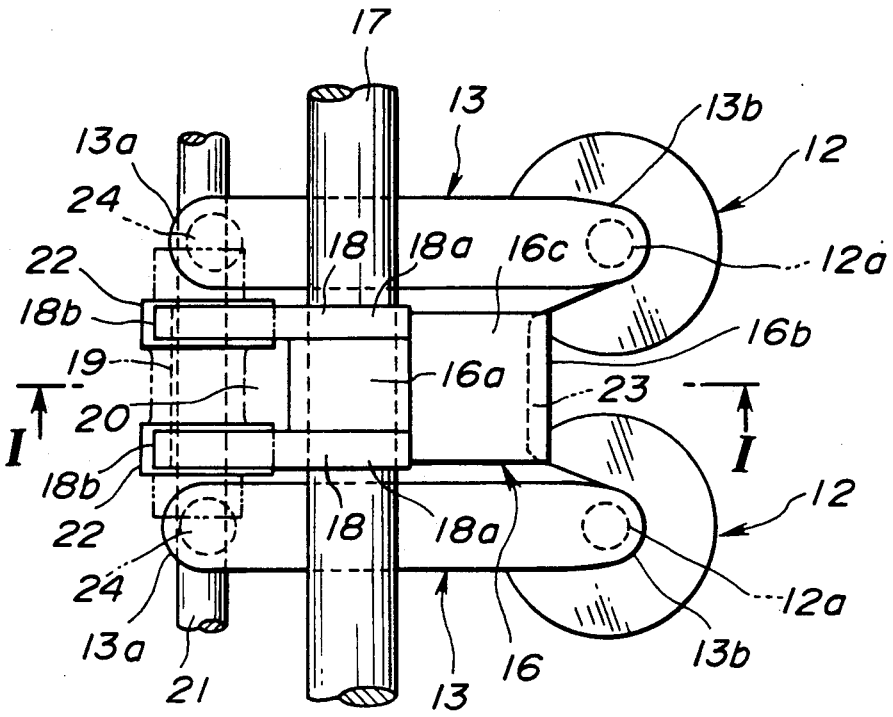
FIG. 2 is a plan view of the valve mechanism of the present invention.
Figure 4:
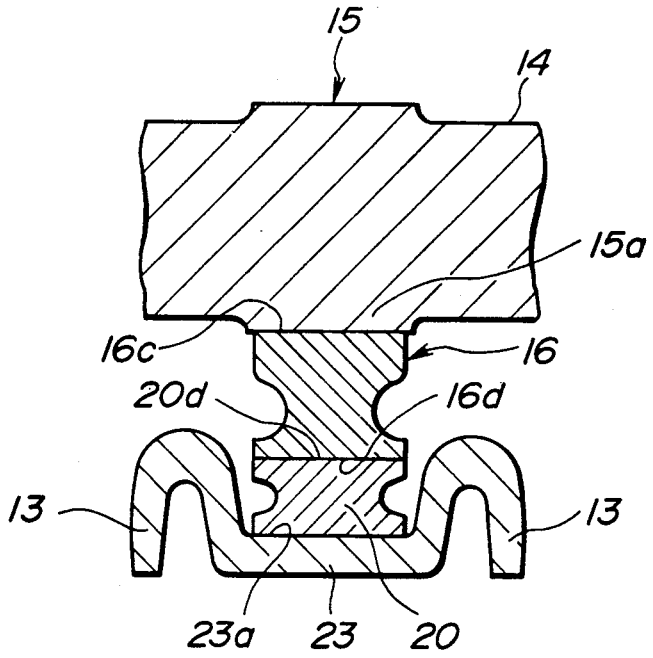
FIG. 4 is a sectional view taken along the line IV—IV of FIG. 1.

As is understood from FIGS. 4, 1 and 2, the swing arms 13 and 13 are integrally connected through an intermediate plate portion 23 thereby to constitute a single structure. The plate portion 23 extends between lower edges of the opposed swing arms 13 and 13.

As is seen from FIGS. 1 and 2, the left ends 13*a* and 13*a* of the swing arms 13 and 13 are pivotally supported on pivots 24 and 24 which are arranged on the cylinder head 11. The other ends 13*b* and 13*b* of the swing arms 13 and 13 are put on upper ends of valve stems 12*a* and 12*a* of the intake valves 12 and 12.

As is seen from FIG. 1, the intermediate plate portion 23 is warped in compliance with curved lower edges of the swings arms 13 and 13. A concave upper surface of the intermediate plate portion 23 is denoted by numeral 23*a*.

As is seen from FIGS. 1 and 2, the cam follower 16 has one end 16*a* pivotally supported by the supporting shaft 17. The other end 16*b* of the cam follower 16 has a convexly curved cam surface 16*c* to which the cam face of the valve driving cam 15 operatively contacts.

As is seen from FIGS. 1 and 4, the cam follower 16 has a lower surface 16*d* shaped generally flat.

As is understood from FIG. 2, the link members 18 and 18 are each shaped like a flat plate and are located at an opposite position of the cam follower 16 with respect to the supporting shaft 17. Each link member 18 has one end pivotally connected to the supporting shaft 17 and the other end 18*b* pivotally connected to the movable shaft 19.

As is seen from FIG. 3, the length of the movable shaft 19 is substantially the same as the distance between the link members 18 and 18, and the movable shaft 19 has both ends which are free, that is, not supported by any member.

As is seen from FIGS. 1 and 3, the lever member 20 is arranged between the link members 18 and 18, which has one end 20*a* pivotally connected to the movable shaft 19. The other end 20*b* of the lever member 20 has a convexly curved lower surface 20*c* which is in contact with the concave upper surface 23*a* of the intermediate plate portion 23. The lever member 20 has an upper flat surface 20*d* which is in contact with the lower surface 16*d* of the cam follower 16.

As is seen from FIG. 3, the control cams 22 and 22 are the same in shape and integrally connected to each other through an intermediate shaft portion 25 thereby to constitute a single structure. Denoted by numeral 26 is a control mechanism which controls the control cams 22 and 22 through the control shaft 21.

As is seen from FIG. 1, the control cams 22 and 22 are in contact with upper surfaces of the link members 18 and 18. Each control cam 22 has the highest and lowest portions 22*a* and 22*b* which are formed on asymmetrical positions thereof with respect an axis of the control shaft 21.

As is seen from FIG. 3, the control mechanism 26 comprises a coiled spring 27 which has one end 27*a* hooked to one end of the shaft portion 25 of the control cams 22 and 22 and the other end 27*b* hooked to a pin (no numeral) secured to the control shaft 21. With this spring 27, the control shaft 21 and thus the control cams 22 and 22 are biased to rotate in a given direction, that is, in a counterclockwise direction in FIG. 1. The control mechanism 26 further comprises an electromagnetic actuator 28 which is arranged to rotate, when energized, the control shaft 21 against the biasing force of the coiled spring 27. The electromagnetic actuator 28 is controlled by a controller 29 in which a microcomputer is installed. By receiving information signals from an crankangle sensor, an airflow meter and the like, the controller 29 judges the existing condition of the engine and controls the actuator 28 in accordance with the judgement.

In the following, operation of the valve mechanism of the invention will be described with reference to FIGS. 5 to 9 of the accompanying drawings.

For ease of understanding, the description will be commenced with respect to a condition wherein the associated internal combustion engine is under low speed and low load condition.

Figure 5:
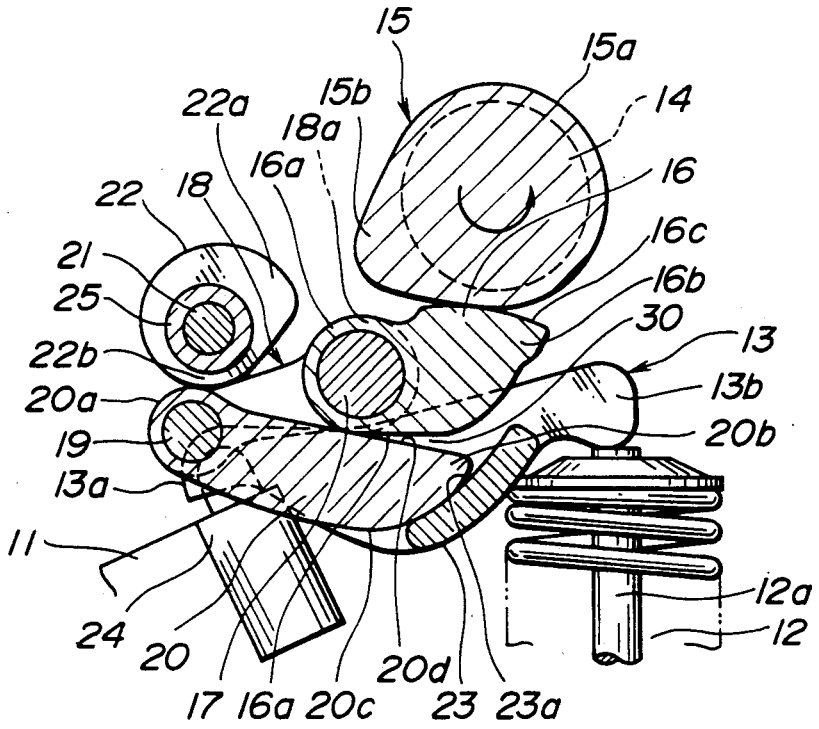
FIG. 5 is a view similar to FIG. 1, but showing one momentary condition taken during the time when an associated internal combustion is under low speed and low load condition.

Under this condition, the valve mechanism assumes the condition as shown in FIG. 5. That is, upon requirement of taking this condition, the electromagnetic actuator 28 is deenergized by OFF instruction from the controller 29. Thus, due to the biasing spring 27, the control cams 22 and 22 are rotated to take such lower positions as shown in FIG. 5 wherein the lowest portions 22*b* and 22*b* of the cams 22 and 22 are in contact with the ends 18*b* and 18*b* of the link members 18 and 18. Thus, the end 20*a* of the lever member 20 is moved upward together with the movable shaft 19 to an upper position, so that the lever member 20 is forced to pivot in a clockwise direction using an outer periphery of the end 16*a* of the cam follower 16 as a fulcrum. During this pivoting movement, the curved lower surface 20*c* of the lever member 20 slides leftward on the concave upper surface 23*a* of the intermediate plate portion 23 while forming a wedge-shaped clearance 30 between the upper surface 20*d* of the lever member 20 and the lower surface 16*d* of the cam follower 16. That is, under this low speed and low load condition of the engine, the valve mechanism assumes the condition as shown in FIG. 5.

With the valve mechanism assuming this condition, rotation of the valve driving cam 15 due to operation of the engine pivots the cam follower 16 by intermittently pressing the cam surface 16*c*. That is, during a period for which the base circle surface 15*a* of the cam 15 is in contact with the cam follower 16 (more specifically, the cam surface 16*c* of the same), the cam 15 does not press down the cam follower 16 and thus the rotation of the cam 15 during such period has substantially no effect on the intake valves 12 and 12.

During a subsequent small period for which a leading part of the raised surface 15*b* of the cam 15 is in contact with the cam follower 16, the cam follower 16 is compelled to pivot idly within the wedge-shaped clearance 30 thereby having no effect on the lever member 20. That is, during the above-mentioned periods, the cam follower 16 does not press down the lever member 20.

However, when thereafter, the leading part of the raised surface 15*b* of the cam 15 moves away from the cam follower 16 bringing the main part of the raised surface 15*b* near the cam surface 16*c* of the cam follower 16, the clearance 30 disappears and thus the cam follower 16 begins to press down the lever member 20. Upon this, the curved lower surface 20*c* of the lever member 20 begins to press down the intermediate plate portion 23 of the swing arms 13 and 13. Accordingly, the other ends 13*b* and 13*b* of the swing arms 13 and 13 begin to press down the intake valves 12 and 12 for opening the intake ports.

Figure 6:
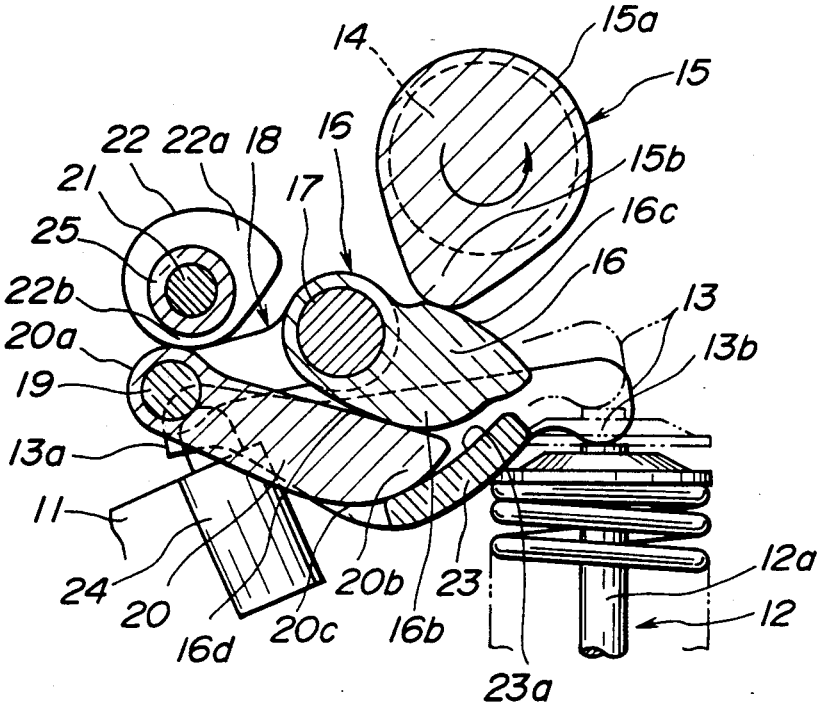
FIG. 6 is a view similar to FIG. 5, but showing another momentary condition taken during the time when the engine is under low speed and low load condition.

When, thereafter, as is shown in FIG. 6, a main part of the raised surface 15*b* of the cam 15 comes into contact with the cam follower 16, the cam follower 16 largely presses down the lever member 20, and thus the lever member 20 largely presses down the swing arms 13 and 13 thereby largely pressing down the intake valves 12 and 12 for fully opening the intake ports.

Figure 9:
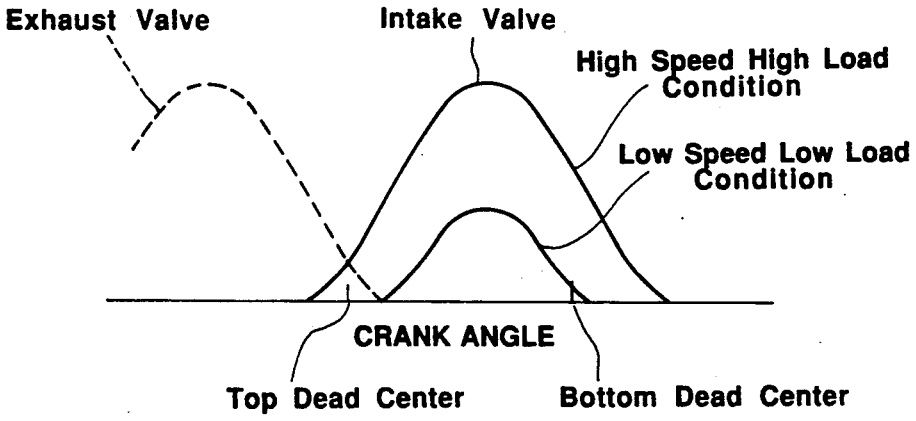
FIG. 9 is a graph showing the valve lift characteristic possessed by the valve mechanism of the invention.

Accordingly, under the low speed and low load condition of the engine, the cam lift characteristic is small and thus, as is seen from the graph of FIG. 9, the valve lift is small and the opening timing of the intake valves 12 and 12 is delayed thereby reducing the valve overwrapping period. Accordingly, the fuel consumption and the operability in the low speed and low load condition are both improved.

Figure 7:
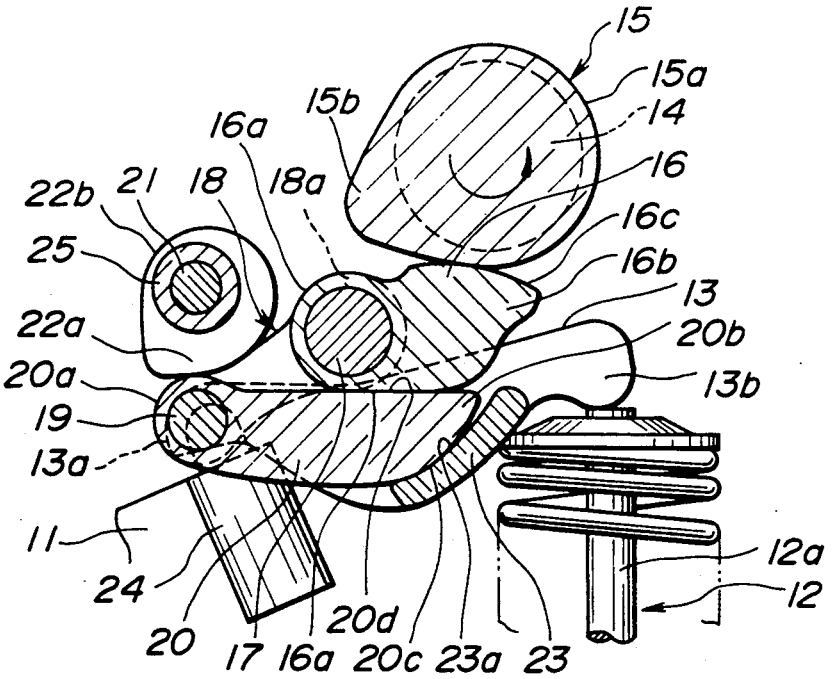
FIG. 7 is a view similar to FIG. 1, but showing one momentary condition taken during the time when the associated internal combustion is under high speed and high load condition.

When thereafter the engine is brought into high speed and high load condition, the electromagnetic actuator 28 is energized by ON instruction from the controller 29. With this, the actuator 28 turns through the control shaft 21 the control cams 22 and 22 in a clockwise direction in FIG. 6 against the biasing force of the coiled spring 27 to such higher positions as shown in FIG. 7 wherein the highest portions 22*a* and 22*a* of the cams 22 and 22 are in contact with the ends 18*b* and 18*b* of the link members 18 and 18. Thus, the end 20*a* of the lever member 20 is moved downward together with the movable shaft 19 to a lower position, so that the lever member 20 is forced to pivot in a counterclockwise direction using the lower surface 16*d* of the cam follower 16 as a so-called fulcrum. During this pivoting movement, the curved lower surface 20*c* of the lever member 20 slides rightward on the concave upper surface 23*a* of the intermediate plate portion 23 permitting a full contact of the upper surface 20*d* of the lever member 20 with the lower surface 16*d* of the cam follower 16 thereby eliminating the above-mentioned wedge-shaped clearance 30 therebetween. That is, under this high speed and high load condition of the engine, the valve mechanism assumes the condition as shown in FIG. 7.

With the valve mechanism assuming this condition, rotation of the valve driving cam 15 due to operation of the engine pivots the cam follower 16 by intermittently pressing the cam surface 16*c*. Similar to the case of the above-mentioned low speed and low load condition, during a time for which the base circle surface 15*a* of the cam 15 is in contact with the cam follower 16, the cam follower 16 does not press down the lever member 20.

However, when, thereafter, the leading part of the raised surface 15*b* of the cam 15 comes near and into contact with the cam follower 16, the cam follower 16 instantly presses down the lever member 20 because of absence of the above-mentioned wedge-shaped clearance therebetween. This downward pivoting of the lever member 20 instantly induces a downward movement of the intermediate plate portion 23 of the swing arms 13 and 13 thereby pressing down the intake valves 12 and 12 for opening the intake ports.

Figure 8:
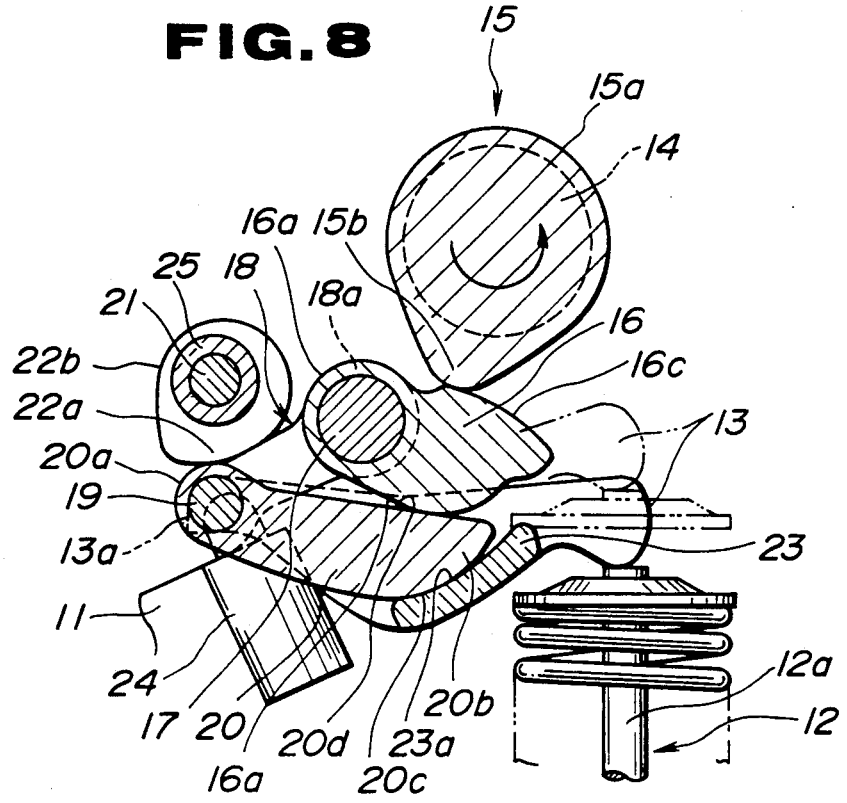
FIG. 8 is a view similar to FIG. 7, but showing another momentary condition taken during the time when the engine is under high speed and high load condition.

When, thereafter, as is shown in FIG. 8, the main part of the raised surface 15*b* of the cam 15 comes into contact with the cam follower 16, the cam follower 16 largely presses down the lever member 20 and the intermediate plate portion 23 of the swing arms 13 and 13. Thus, the intake valves 12 and 12 are largely pressed down for fully opening the intake ports.

Accordingly, under the high speed and high load condition of the engine, the cam lift characteristic is incrased and thus, as is seen from the graph of FIG. 9, the valve lift is increased and the opening timing of the intake valves 12 and 12 is advanced. Accordingly, the mixture charging efficiency of the engine is increased and thus sufficient output of the same is obtained.

In the following, advantages of the present invention will be described.

Figure 10:
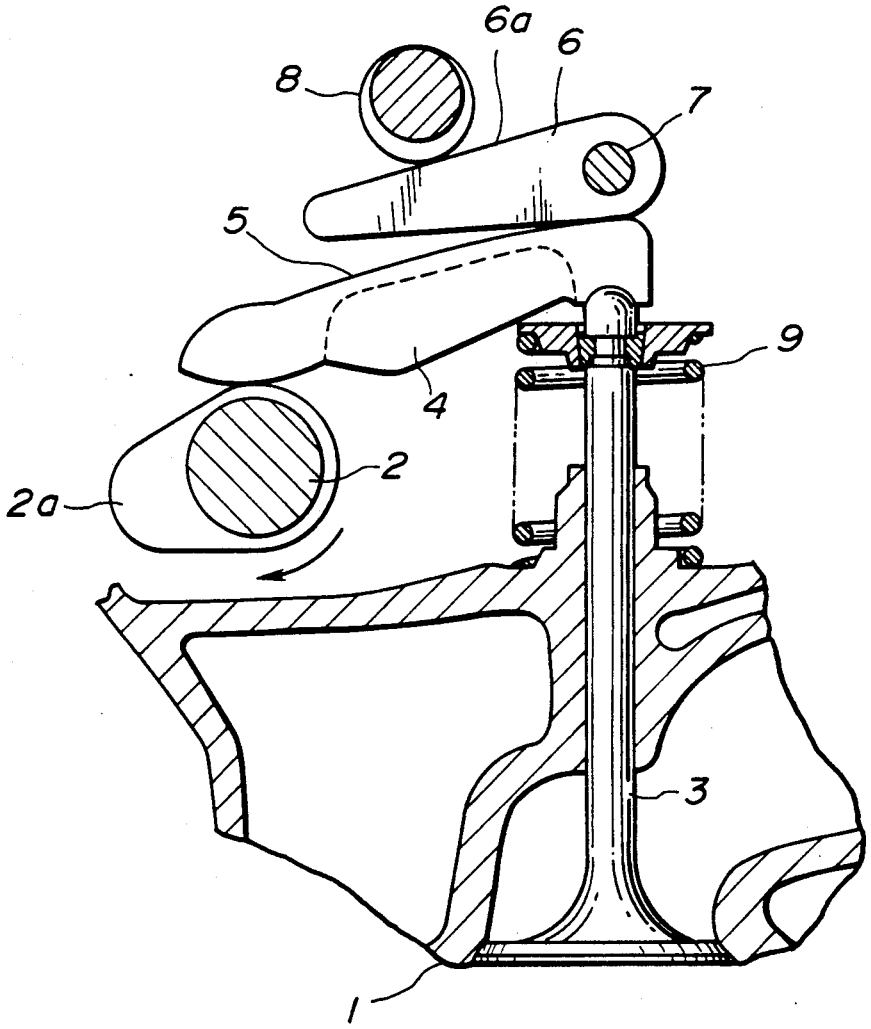
FIG. 10 (PRIOR ART)
FIG. 10 is a sectional view of a conventional valve mechanism.

First, since the unit including the cam shaft 14 and the valve driving cam 15 can be arranged above the intake valves 12 and 12 unlike in the case of the above-mentioned conventional valve mechanism of FIG. 10, the freedom in layout of an associated ignition spark plug is not restricted by such unit. This means that the ignition plug can be located at a desired position in the combustion chamber.

Second, since the cam follower 16 and the link members 18 and 18 are connected through the common supporting shaft 17 and since the link members 18 and 18 are connected through the common movable shaft 19, the valve mechanism can be made compact in size.

Third, since the swing arms 13 and 13 are integrally connected through the intermediate plate portion 23 to constitute a single structure, the mechanical strength of each swing arm 13 is increased and production of the swing arms 13 and 13 is easy.

Although the above description is directed to only the valve mechanism for the intake valves 12 and 12, the concept of the present invention is applicable to a valve mechanism for exhaust valves as well as valve mechanisms for both intake and exhaust valves. Furthermore, in place of the above-mentioned electromagnetic actuator 28, a hydraulic actuator may be used for actuating the link members 18 and 18.

What is claimed is:

1. A valve mechanism for an internal combustion engine having a plurality of intake or exhaust valves for each cylinder, comprising:

a cam shaft rotated in synchronization with operation of the engine;

a valve driving cam integrally mounted on said cam shaft to rotate therewith;

a swing structure positioned below said valve driving cam, said swing structure being pivotally supported on a fixed portion of the engine and having leading ends which are respectively put on stems of said valves;

a supporting shaft extending in parallel with said cam shaft;

a cam follower having one end pivotally connected to said supporting shaft and the other end slidably engaged with said valve driving cam;

a link structure pivotally connected to said supporting shaft and extending in a direction away from said cam follower, said link structure having a pivot shaft connected to the extending end thereof;

a lever member having one end pivotally connected to said pivot shaft and the other end movably interposed between said swing structure and said cam follower; and a control means for pivoting said link structure about said supporting shaft in accordance with an operation condition of the engine.

2. A valve mechanism as claimed in claim 1, in which said swing structure comprises:

two spaced swing arms each having one end pivotally supported on the fixed portion and the other end slidably put on a head of the valve stem; and an intermediate plate portion extending between said two swing arms, said intermediate plate portion having a concave upper surface to which the other end of said lever member slidably contacts.

3. A valve mechanism as claimed in claim 2, in which said lever member has at the other end thereof a convexly curved lower surface which slidably contacts to said concave upper surface of said swing structure.

4. A valve mechanism as claimed in claim 3, in which said lever member has at the other end thereof an upper flat surface which is contactable with a flat lower surface of said cam follower.

5. A valve mechanism as claimed in claim 4, in which said link structure comprises:

two spaced link members each having one end pivotally connected to said supporting shaft and extending away from said cam follower; and said pivot shaft extending between the leading ends of the two link members.

6. A valve mechanism as claimed in claim 5, in which said lever member is located between said two link members.

7. A valve mechanism as claimed in claim 6, in which said control means comprises:

a cam structure having two identical cams which are in contact with respective upper surfaces of the extending portions of said two spaced link members;

a control shaft on which said cam structure is securely mounted;

an electromagnetic actuator which, when energized, rotates said control shaft about its axis; and a controller for controlling said electromagnetic actuator in accordance with the operation condition of the engine.

8. A valve mechanism as claimed in claim 1, in which said control means pivots said link structure between first and second positions, said first position being a position wherein the pivoted one end of said cam follower is contactable with an upper flat surface of said lever member and said second position being a position wherein the other end of said cam follower is contactable with said upper flat surface of said lever member.

9. A valve mechanism as claimed in claim 8, in which said control means comprises:

a cam structure which is in contact with the extending end of said link structure;

a control shaft on which said cam structure is securely mounted;

an electromagnetic actuator which, when energized, rotates said control shaft about its axis; and a controller for controlling said electromagnetic actuator in accordance with the operation condition of the engine.

10. A valve mechanism as claimed in claim 9, in which said control means further comprises a biasing spring by which said control shaft is biased to rotate in a given direction about its axis.

11. A valve mechanism as claimed in claim 8, in which said first position of said link structure is set when the engine is under low speed and low load condition and said second position of said link structure is set when the engine is under high speed and high load condition.

* * * * *